US007670130B2

(12) United States Patent
Logan

(10) Patent No.: US 7,670,130 B2
(45) Date of Patent: Mar. 2, 2010

(54) CEMENT SHUTTER

(75) Inventor: Richard J. Logan, Oxford, MI (US)

(73) Assignee: Tapco International Corporation, Wixom, MI (US)

( * ) Notice: Subject to any disclaimer, the term of this patent is extended or adjusted under 35 U.S.C. 154(b) by 553 days.

(21) Appl. No.: 11/536,468

(22) Filed: Sep. 28, 2006

(65) Prior Publication Data

US 2007/0176076 A1 Aug. 2, 2007

Related U.S. Application Data

(60) Provisional application No. 60/724,309, filed on Oct. 6, 2005.

(51) Int. Cl.
*E04G 9/00* (2006.01)

(52) U.S. Cl. ..... 425/403; 425/402

(58) Field of Classification Search ..... 425/500, 425/402, 403, 391; 156/216; 493/250, 251, 493/252, 253

See application file for complete search history.

(56) References Cited

U.S. PATENT DOCUMENTS

| | | | | | |
|---|---|---|---|---|---|
| 3,009,201 | A | * | 11/1961 | Hansen | 425/374 |
| 4,025,259 | A | | 5/1977 | Howe et al. | |
| 4,031,684 | A | | 6/1977 | Shibata | |
| 4,088,808 | A | | 5/1978 | Cornwell et al. | |
| 4,229,497 | A | * | 10/1980 | Piazza | 428/71 |
| 4,415,325 | A | * | 11/1983 | Fuchs et al. | 425/397 |
| 4,478,664 | A | * | 10/1984 | Elias | 156/216 |
| 5,013,157 | A | | 5/1991 | Mills et al. | |
| 5,106,282 | A | * | 4/1992 | Sullivan, Sr. | 425/112 |
| 5,114,487 | A | | 5/1992 | Gartshore et al. | |
| 5,366,549 | A | | 11/1994 | Imaizumi et al. | |
| 5,391,019 | A | | 2/1995 | Morgan | |
| 5,552,095 | A | | 9/1996 | Merser et al. | |
| 5,573,348 | A | | 11/1996 | Morgan | |
| 5,617,683 | A | | 4/1997 | Ney | |
| 5,922,124 | A | | 7/1999 | Supplee | |
| 6,241,815 | B1 | | 6/2001 | Bonen | |
| 6,358,575 | B1 | | 3/2002 | Spragg | |
| RE37,655 | E | | 4/2002 | Supplee | |
| 6,528,547 | B2 | | 3/2003 | Shulman | |
| 6,613,424 | B1 | | 9/2003 | Putt et al. | |
| 6,625,948 | B2 | | 9/2003 | Valente | |
| 6,638,355 | B2 | | 10/2003 | Shulman | |

(Continued)

FOREIGN PATENT DOCUMENTS

| | | |
|---|---|---|
| EP | 0053587 | 6/1982 |

(Continued)

*Primary Examiner*—Joseph S Del Sole
*Assistant Examiner*—Robert Dye
(74) *Attorney, Agent, or Firm*—Howard & Howard Attorneys PLLC

(57) ABSTRACT

A shutter assembly having at least one rigid edge and at least one hanger edge is described. The rigid edge provides stability to the shutter assembly and the hanger edge allows the shutter assembly to be mounted to a dwelling. The shutter assembly can be formed in an open mold from a cementitious slurry comprising gypsum cement and water. A reinforcing mat or fiber can be disposed in the mold and saturated with the cementitious slurry. A tool disposed adjacent the mold and including a plurality of rotatable sections can be used to form the rigid edge and the hanger edge.

21 Claims, 7 Drawing Sheets

U.S. PATENT DOCUMENTS

| | | | | |
|---|---|---|---|---|
| 6,805,741 | B1 | 10/2004 | Liu et al. | |
| 6,881,256 | B2 | 4/2005 | Orange et al. | |
| 6,913,819 | B2 | 7/2005 | Wallner | |
| 6,927,183 | B1 | 8/2005 | Christen | |
| 6,941,720 | B2 | 9/2005 | DeFord et al. | |
| 6,942,727 | B2 | 9/2005 | Daczko et al. | |
| 6,960,394 | B2 | 11/2005 | Graham et al. | |
| 7,147,708 | B2 | 12/2006 | Nagler, Jr. et al. | |
| 7,232,589 | B2 * | 6/2007 | Christen | 427/350 |
| 2002/0090871 | A1 | 7/2002 | Ritchie et al. | |
| 2003/0200714 | A1 | 10/2003 | Minke et al. | |
| 2004/0010988 | A1 | 1/2004 | Jaycox et al. | |
| 2004/0040256 | A1 | 3/2004 | Bui | |
| 2004/0040257 | A1 | 3/2004 | Bui | |
| 2004/0045713 | A1 | 3/2004 | Bianchi et al. | |
| 2004/0231273 | A1 | 11/2004 | Bamford | |
| 2005/0045069 | A1 | 3/2005 | McCarthy et al. | |
| 2005/0064055 | A1 | 3/2005 | Porter | |
| 2005/0064164 | A1 | 3/2005 | Dubey et al. | |
| 2005/0183632 | A1 | 8/2005 | Sturre | |
| 2006/0201090 | A1 | 9/2006 | Guevara et al. | |
| 2007/0176076 | A1 | 8/2007 | Logan | |
| 2008/0003398 | A1 | 1/2008 | Logan | |
| 2008/0028711 | A1 | 2/2008 | Logan et al. | |

FOREIGN PATENT DOCUMENTS

| | | |
|---|---|---|
| EP | 0252334 | 1/1988 |
| EP | 0921107 | 6/1999 |
| JP | 04110102 | 4/1992 |
| WO | 2004/081296 | 9/2004 |
| WO | 2005/082065 | 9/2005 |

* cited by examiner

CEMENT SHUTTER

CROSS-REFERENCE TO RELATED APPLICATION

The instant application claims priority to U.S. Provisional Patent Application Ser. No. 60/724,309, filed Oct. 6, 2005, the entire specification of which is expressly incorporated herein by reference.

BACKGROUND OF THE INVENTION

1. Field of the Invention

The present invention generally relates to shutter assemblies and more specifically to shutter assemblies formed from cementitious slurries.

2. Description of the Related Art

Many different modern building designs take advantage of modular shutters for purely aesthetic purposes to decorate exterior windows. The modular shutter assemblies are generally an assembly of plastic parts that are individually formed and then secured together in a cost effective manner. The different plastic parts can be formed by different plastic fabrication techniques such as injection molding and extrusion. The plastic parts are secured together by appropriate fastening mechanisms, such as screws, adhesives, and/or the like, in a manner that is well understood in the art.

Because the windows of a house or other building can come in various sizes, the length and width of the modular shutter assemblies must also be available in different lengths and widths to appropriately accommodate the different windows. For example, for windows having a different height, it is necessary that the panels come in different lengths to extend the length of the shutter assemblies and appropriately accent the lengths of the windows. Because known panels are typically injection molded plastic parts, different size molds have heretofore been necessary to provide for different length panels. As is well understood, injection molds are relatively expensive components. Because the shutter assemblies are relatively inexpensive articles, the necessity to provide many different sized molds for all of the different sized windows significantly adds to the cost of the shutter assemblies.

Further, the shutter assemblies must be secured to dwellings using various fasteners or clips. Attaching the fasteners to the shutter assemblies has been problematic and results in the shutter assemblies having weakened areas. These shutter assemblies also have a tendency to be less sturdy than desired, especially when subject to high winds, which results in the shutter assemblies disintegrating.

Therefore, it would be advantageous to provide shutter assemblies that overcome at least one of the aforementioned disadvantages.

SUMMARY OF THE INVENTION AND ADVANTAGES

In accordance with the general teachings of the present invention, a shutter assembly is provided having at least one rigid edge and at least one hanger edge. In one aspect of the present invention, the rigid edge provides stability to the shutter assembly and the hanger edge allows the shutter assembly to be mounted to a dwelling. The shutter assembly can be formed in an open mold from cementitious slurry comprising gypsum cement and water. The cementitious slurry can be added in an amount to saturate a reinforcing mat or fiber. The present invention also provides a tool to form the rigid edge and the hanger edge.

In accordance with a first embodiment of the present invention, a system for forming a shutter assembly is provided, comprising: (1) a mold system having a mold face formed thereon; and (2) a tool system proximate to an edge portion of the mold face, wherein the tool system includes at least two portions, wherein a first portion is rotatable about a living hinge disposed between the first portion and a second portion, wherein the first rotatable portion is selectively operable to manipulate an insert member disposed on the mold face so as to form on the insert member a configuration selected from the group consisting of a hanger member, an edge member, and combinations thereof.

In accordance with one aspect of this embodiment, a third tool system portion is provided, wherein the third portion is rotatable about a living hinge disposed between the first portion and the third portion. The third rotatable portion is selectively operable to manipulate an insert member disposed on the mold face so as to form on the insert member a configuration selected from the group consisting of a hanger member, an edge member, and combinations thereof.

In accordance with another aspect of this embodiment, the insert member comprises a reinforcement material.

In accordance with still another aspect of this embodiment, a second insert member is provided.

In accordance with yet another aspect of this embodiment, the insert member is selectively operable to be manipulated by the tool system so as to substantially envelope the second insert member. The second insert member comprises a material selected from the group consisting of a foam material, plastic material, and combinations thereof. The second insert member includes a substantially square or rectangular cross-section.

In accordance with still yet another aspect of this embodiment, the shutter assembly is comprised of a cementitious material.

In accordance with a first alternative embodiment of the present invention, a system for forming a shutter assembly is provided, comprising: (1) a mold system having a mold face formed thereon; and (2) a tool system proximate to an edge portion of the mold face, wherein the tool system includes at least three portions, wherein a first portion is rotatable about a first living hinge disposed between the first portion and a second portion, wherein the second portion is rotatable about a second living hinge disposed between the second portion and a third portion, wherein the first and second rotatable portions are selectively operable to manipulate an insert member disposed on the mold face so as to form on the insert member a configuration selected from the group consisting of a hanger member, an edge member, and combinations thereof.

In accordance with one aspect of this embodiment, the insert member comprises a reinforcement material.

In accordance with another aspect of this embodiment, a second insert member is provided.

In accordance with still another aspect of this embodiment, the insert member is selectively operable to be manipulated by the tool system so as to substantially envelope the second insert member.

In accordance with yet another aspect of this embodiment, the second insert member comprises a material selected from the group consisting of a foam material, plastic material, and combinations thereof. The second insert member includes a substantially square or rectangular cross-section.

In accordance with still yet another aspect of this embodiment, the shutter assembly is comprised of a cementitious material.

In accordance with a second alternative embodiment of the present invention, a method for forming a shutter assembly is provided, comprising: (1) providing a mold system having a mold face formed thereon; (2) providing a tool system proximate to an edge portion of the mold face, wherein the tool system includes at least two portions, wherein the first portion is rotatable about a living hinge disposed between the first portion and a second portion; and (3) selectively manipulating the rotatable first portion so as to manipulate an insert member disposed on the mold face to form on the insert member a configuration selected from the group consisting of a hanger member, an edge member, and combinations thereof.

In accordance with one aspect of this embodiment, a third tool system portion is provided, wherein the third portion is rotatable about a living hinge disposed between the first portion and the third portion. The third rotatable portion is selectively operable to manipulate an insert member disposed on the mold face so as to form on the insert member a configuration selected from the group consisting of a hanger member, an edge member, and combinations thereof.

In accordance with another aspect of this embodiment, the insert member comprises a reinforcement material.

In accordance with still another aspect of this embodiment, a second insert member is provided.

In accordance with yet another aspect of this embodiment, the tool system is manipulated so as to selectively manipulate the insert member so as to substantially envelope the second insert member.

In accordance with still yet another aspect of this embodiment, the second insert member comprises a material selected from the group consisting of a foam material, plastic material, and combinations thereof. The second insert member includes a substantially square or rectangular cross-section.

In accordance with a further aspect of this embodiment, an amount of cementitious slurry is applied to the insert member before the rotatable second portion is selectively manipulated.

In accordance with a still further aspect of this embodiment, the shutter assembly is comprised of a cementitious material.

Further areas of applicability of the present invention will become apparent from the detailed description provided hereinafter. It should be understood that the detailed description and specific examples, while indicating the preferred embodiment of the invention, are intended for purposed of illustration only and are not intended to limit the scope of the invention.

BRIEF DESCRIPTION OF THE DRAWINGS

The present invention will become more fully understood from the detailed description and the accompanying drawings, wherein.

The same reference numerals refer to the same parts throughout the various Figures.

DETAILED DESCRIPTION OF THE INVENTION

The following description of the preferred embodiment(s) is merely exemplary in nature and is in no way intended to limit the invention, or uses.

Figure 1:
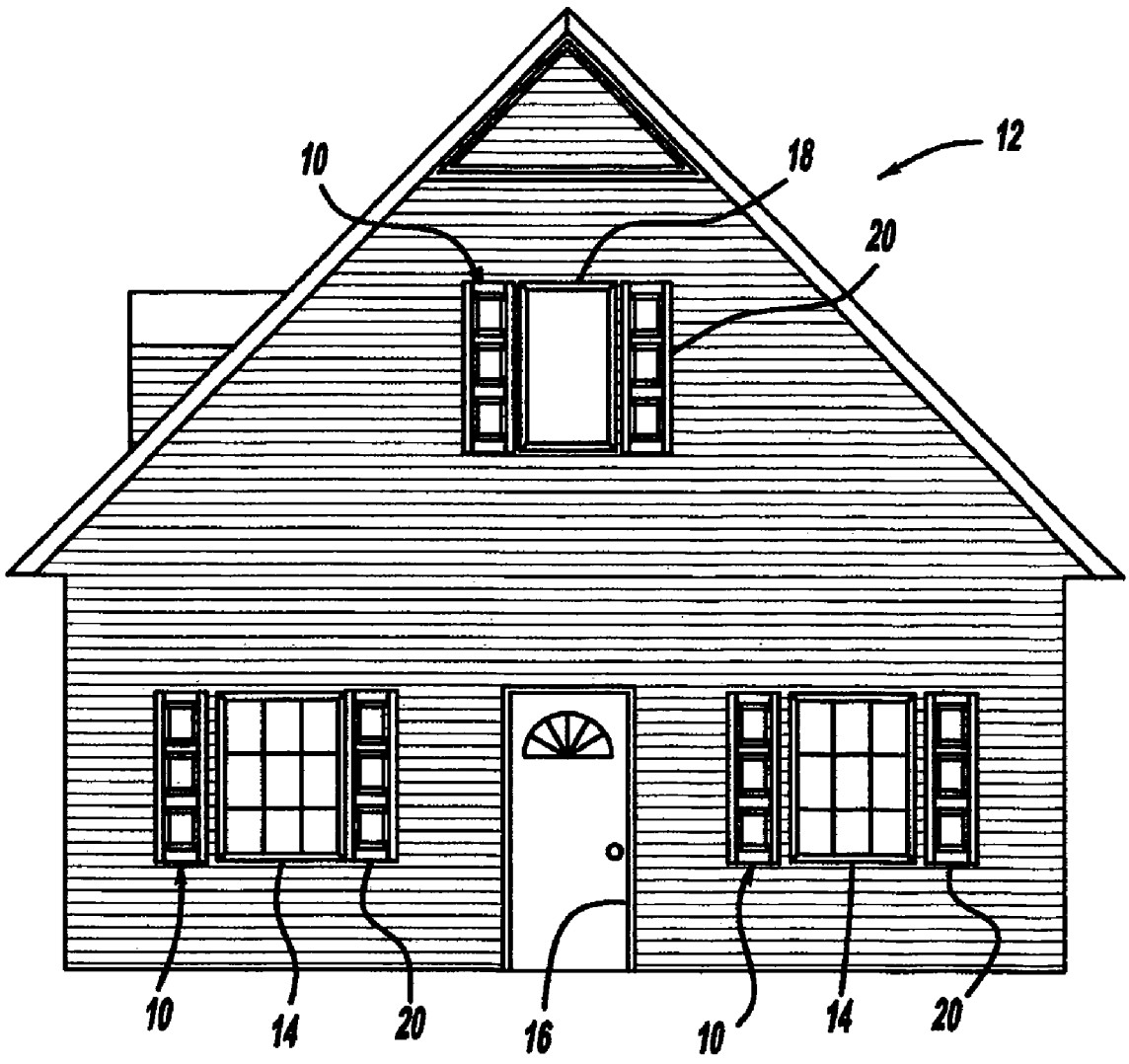
FIG. 1 is an exterior front view of a dwelling that includes two lower story front windows positioned on opposite sides of a door and an upper story front window.
Figure 2A:
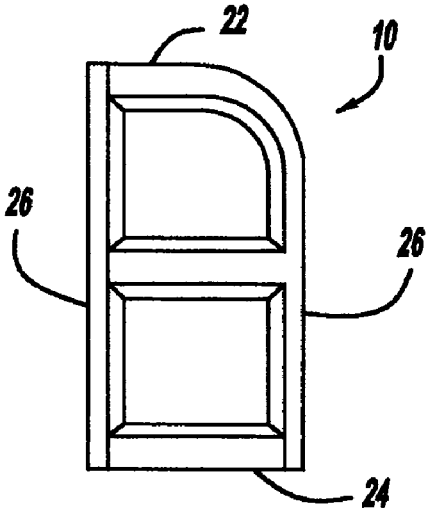
FIGS. 2A-2E are front views of various configurations of shutter assemblies.
Figure 2B:
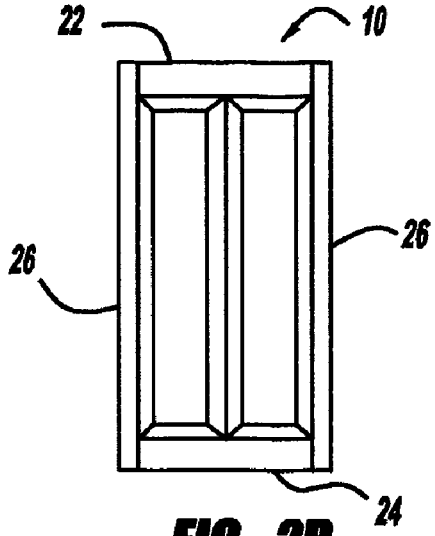
Figure 2C:
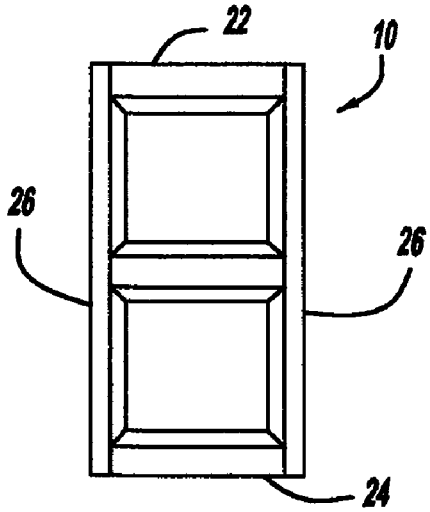
Figure 2D:
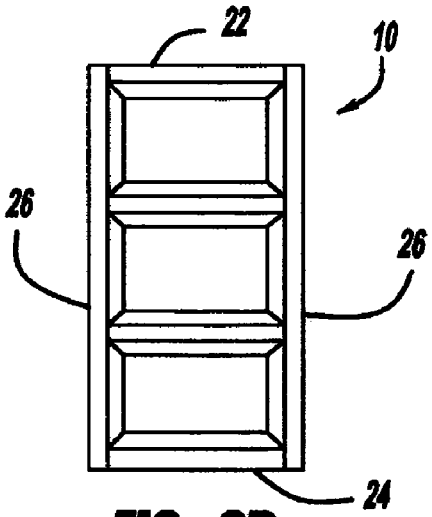
Figure 2E:
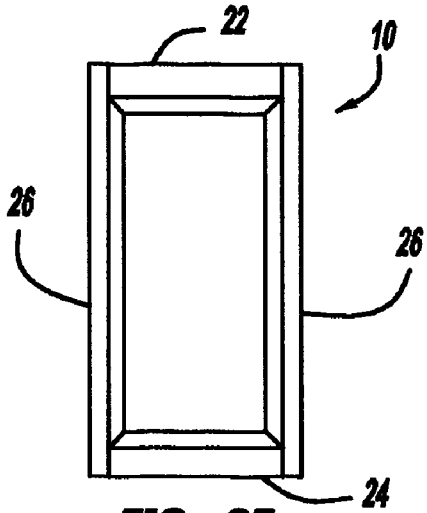
Figure 3A:
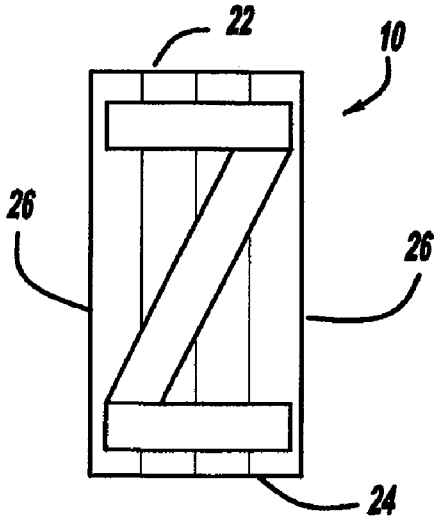
FIGS. 3A-3E are front views of various configurations of shutter assemblies.
Figure 3B:
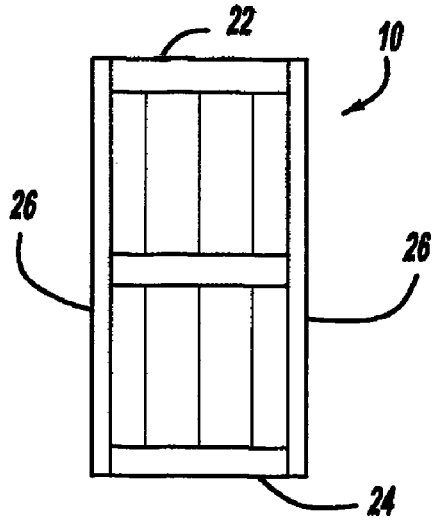
Figure 3C:
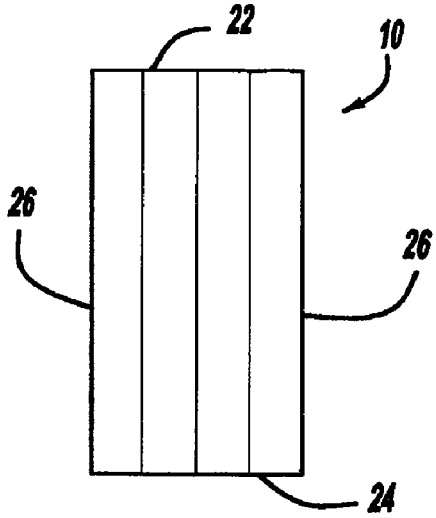
Figure 3D:
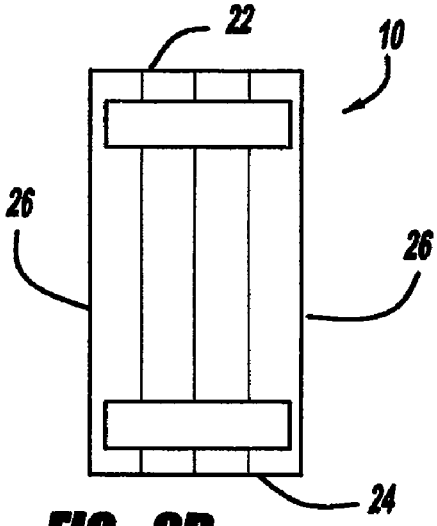
Figure 3E:
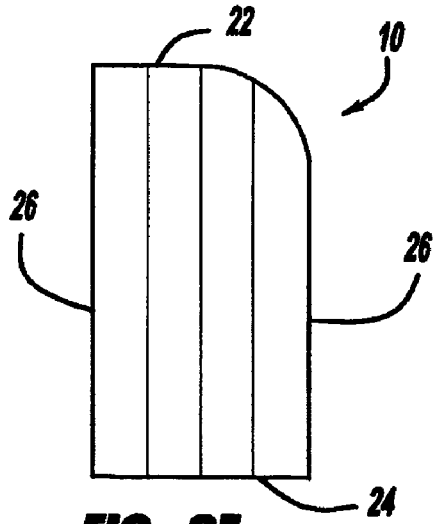

Referring to the Figures, a shutter assembly is generally disclosed at 10. The shutter assembly 10 can be used for both aesthetic and functional purposes on a dwelling 12, such as a residential building, a commercial building, and/or the like. FIG. 1 shows an exterior front view of a house 12 that includes two lower story front windows 14 positioned on opposite sides of a door 16 and an upper story front window 18. The layout and style of the windows 14, 18, respectively, show different types of popular window designs for different types of houses or other buildings. Positioned on both sides of each of the windows 14, 18, respectively, is a modular shutter assembly 10 where each shutter assembly 10 includes a plurality of panels, here three panels. The modular shutter assemblies 10 are rigidly secured to a front wall of the house 12, by appropriate securing devices (not shown) known in the art, at a location that aesthetically accents the windows 14, 18, respectively. The shutter assemblies 10 do not provide a functional purpose, but are provided for only aesthetic reasons. Various configurations of the shutter assembly 10 are shown in FIGS. 2A-2E and 3A-3E. Another configuration that can be used with the present invention includes louvered shutters.

It is to be understood that one shutter assembly 10 according to the present invention is a single shutter 20. That is, one shutter assembly 10 is one left side shutter 20 or one right side shutter 20 such that two shutter assemblies 10 are preferred. Each shutter assembly 10 has a top 22, a bottom 24, and two sides 26 extending between the top 22 and bottom 24. The shutter assembly 10 should include at least two rigid edges (to be described herein) to provide strength to the shutter assembly 10 and at least one hanger edge (to be described herein) for mounting the shutter assembly 10 to the dwelling 12. More preferably, the sides 26 form the rigid edges and the top 22 and the bottom 24 form the hanger edges.

Figure 4:
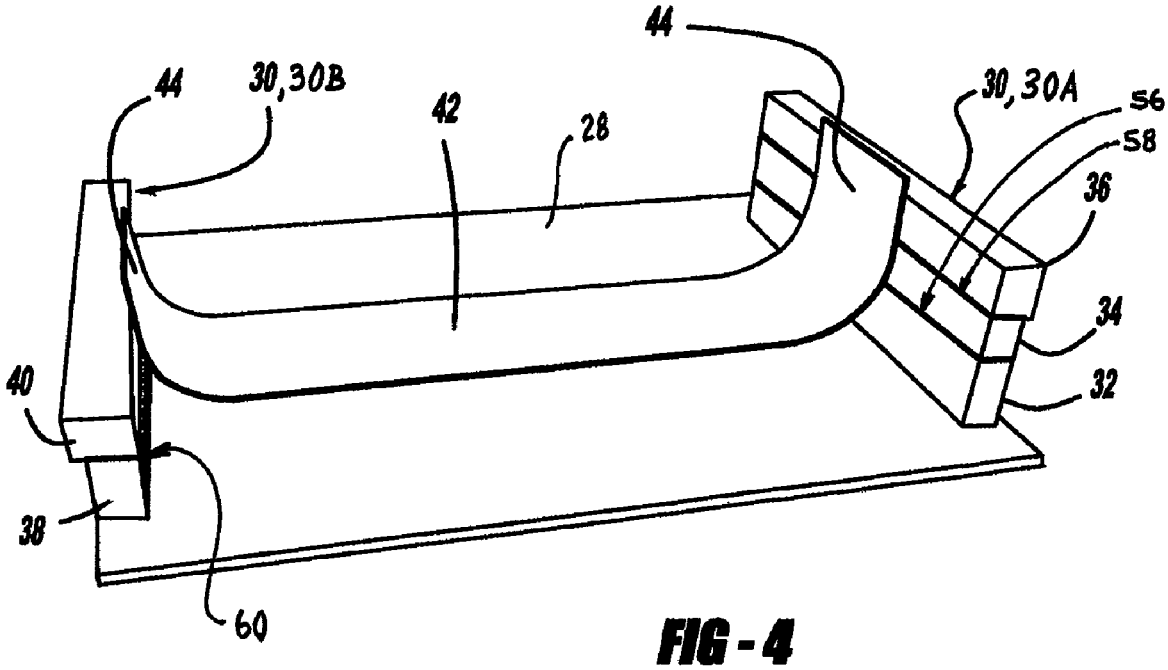
FIG. 4 is a perspective view of a portion of a mold and two different types of tools adjacent the mold face for use in forming a shutter assembly, a reinforcing material mat insert also shown.

Referring to FIG. 4, one embodiment of forming the rigid edge or rigid edge member 48 of the shutter assembly 10 is shown being formed in an open mold system having a mold face 28. The mold system includes an open shell having mold face 28 in any of various configurations. The mold system can be formed of any type of material, such as rigid or flexible materials; however, preferably the portion of the mold system including mold face 28 is formed from a flexible material.

The mold system may be used with a tool system that includes a pair of tools 30 positioned adjacent the mold face 28 for forming vertical sides 26. Each tool 30 includes a plurality of portions or sections connected to one another by a living hinge that allows the sections to move relative to each other. Preferably the tools 30 of the pair are identical and located on opposing edges of the mold face 28. Those of ordinary skill in the art will recognize that each of the opposed tools 30 used with the mold system is used for forming one of a pair of opposed edges of a shutter 20, such as at opposed vertical sides 26, or opposed top 22 and bottom 24. For example, the right-most tool 30 shown in FIG. 4, a first type designated herein as tool 30A, is formed of three sections, e.g., a first section 32, a second section 34, and a third section 36, while the left-most tool 30, a second type designated herein as tool 30B, is formed of two sections, e.g., a lower section 38 and an upper section 40. It is to be appreciated that each tool 30 can be integrally formed with the mold system or a separate component that can be used in combination with the mold system or other molds. Although different type tools 30A and 30B are shown at opposing edges of mold face 28 in FIG. 4, such need not occur in practive, as mentioned above and will become evident from the description that follows.

In the embodiment shown, a reinforcing mat 42 is disposed within the mold on face 28 such that at least one portion 44 of the mat extends along the tool 30 at each opposing edge of the mold face. The reinforcing mat 42 preferably includes fibers, e.g., either chopped or continuous fibers, comprising at least one of polypropylene fibers, polyester fibers, glass fibers, and aromatic polyamide fibers.

The reinforcing mat 42 can include a combination of the fibers, such as the polypropylene fibers and the glass fibers or the polyester fibers and the glass fibers or a blend of the polypropylene fibers and the polyester fibers and the glass fibers. If included in the fiber composition, the aromatic polyamide fibers can be formed from poly-paraphenylene terephthalamide, which is a nylon-like polymer commercially available as KEVLAR® from DuPont (Wilmington, Del.). Of course, aromatic polyamide fibers other than KEVLAR® are suitable for use in the fiber composition of the present invention.

In an alternate embodiment, the reinforcing mat 42 can be replaced with chopped fibers that are sprayed simultaneously with the cementitious slurry. A chopper gun (not shown) can be used to chop the fibers and feed the fibers into the stream of the slurry. The chopped fibers can be selected from any of the fibers forming the reinforcing mat 42.

After the reinforcing mat 42 is positioned in the mold 28, cementitious slurry is sprayed into the mold 28 and coats the reinforcing mat 42 including those portions 44 in contact with vertical sides of the tool 30. The slurry is provided in an amount to adequately saturate the reinforcing mat 42. The slurry can include hydraulic cement including, but not limited to, Portland, sorrel, slag, fly ash, or calcium alumina cement. Additionally, the cement can include a calcium sulfate alpha hemihydrate or calcium sulfate beta hemihydrate. The slurry can also utilize natural, synthetic, or chemically modified beta gypsum or alpha gypsum cement. The cementitious slurry preferably includes gypsum cement and water.

Gypsum is a naturally occurring mineral, calcium sulfate dihydrate, $CaSO_4.2H_2O$ (unless otherwise indicated, hereafter, "gypsum" will refer to the dihydrate form of calcium sulfate). After being mined, the raw gypsum is thermally processed to form a settable calcium sulfate, which can be anhydrous, but more typically is the hemihydrate, $CaSO_4.\frac{1}{2}H_2O$. For the familiar end uses, the settable calcium sulfate reacts with water to solidify by forming the dihydrate (gypsum). The hemihydrate has two recognized morphologies, alpha and beta hemihydrate. These are selected for various applications based on their physical properties. Upon hydration, alpha hemihydrate is characterized by giving rise to rectangular-sided crystals of gypsum, while beta hemihydrate is characterized by hydrating to produce needle-shaped crystals of gypsum, typically with large aspect ratio. In the present invention, either or both of the alpha or beta forms can be used, depending on the mechanical performance required. The beta form generates less dense microstructures and is preferred for low density products. Alpha hemihydrate could be substituted for beta hemihydrate to increase strength and density or they could be combined to adjust the properties.

The cementitious slurry can also include other additives. The additives can include accelerators and retarders to control setting times of slurry. Suitable accelerators include aluminum sulfate, potassium sulfate, and Terra Alba ground gypsum. Additional additives can be used to produce colored shutter assemblies 10, such dry powder metallic oxides such as iron and chrome oxide and pre-dispersed pigments used for coloring latex paints.

Figure 5:
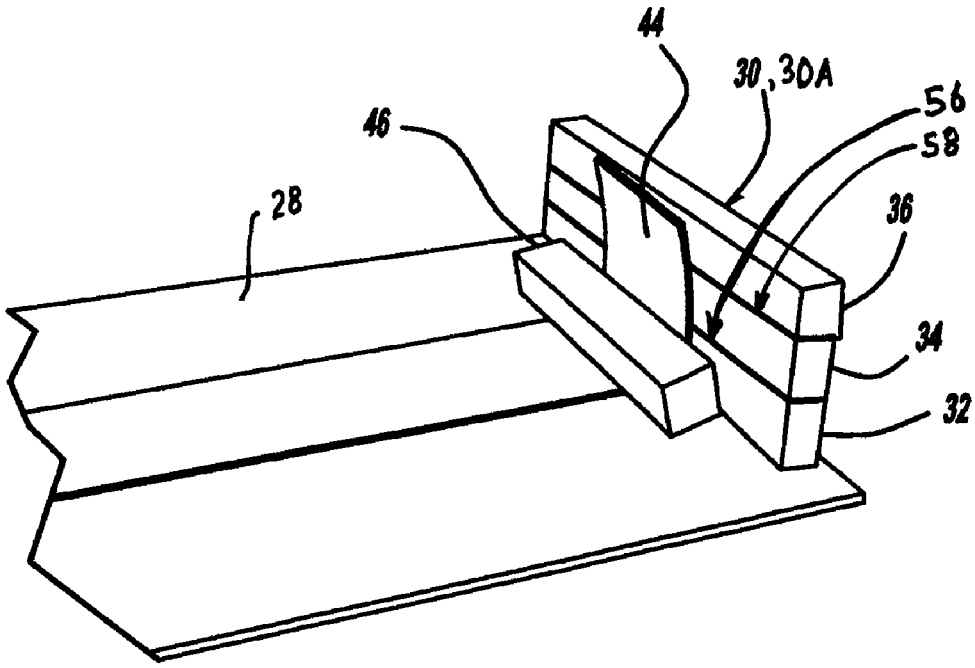
FIG. 5 is a partial perspective view of the mold portion and the first tool type having an insert for use in forming a rigid edge of the shutter assembly.
Figure 6:
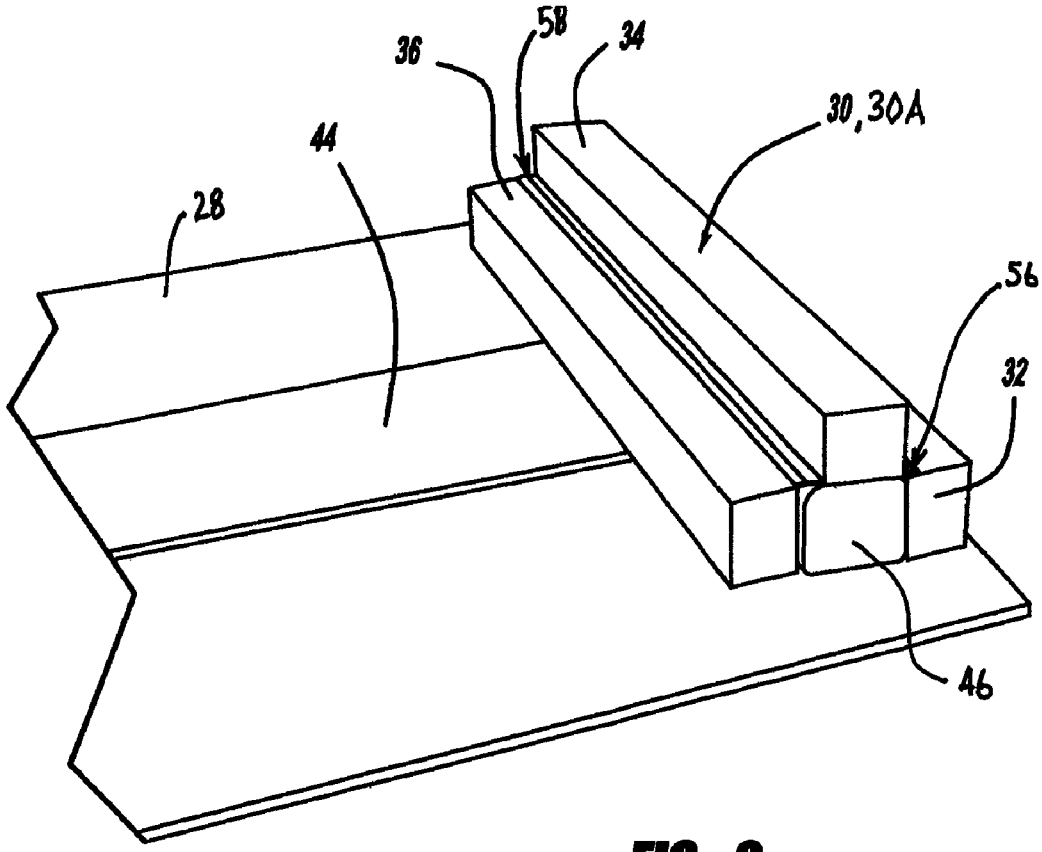
FIG. 6 is a perspective view of the first type tool after forming the rigid edge.
Figure 7:
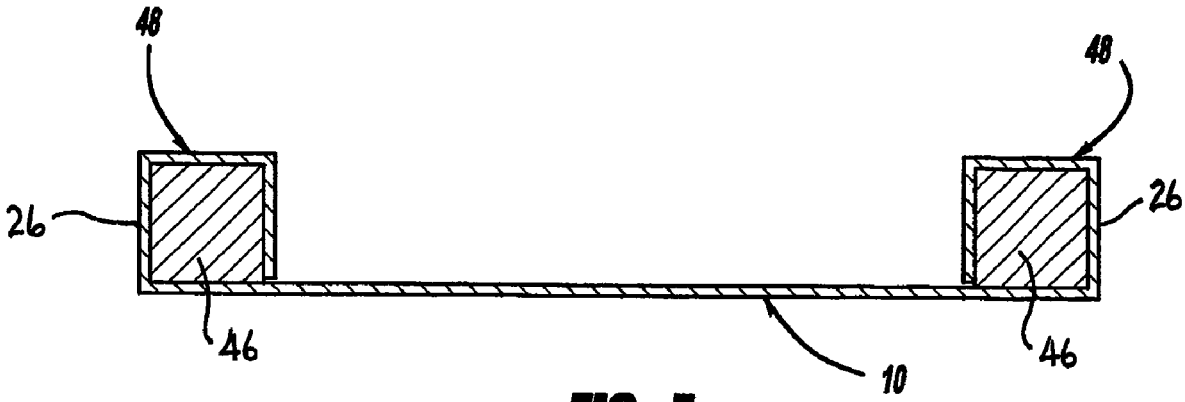
FIG. 7 is a cross-sectional view of the shutter assembly having two rigid edges formed according to FIG. 6.

Referring to FIGS. 5-7, while the slurry is still wet, the rigid edge 48 of the shutter assembly 10 can be formed by positioning an insert 46 in the corner formed between the mold face 28 and the tool 30 having three sections, i.e., tool 30A. The insert 46 functions as a mandrel that comprises a separable part of the shutter forming system, and in some embodiments of shutter 20 may remain with the shutter after it has been formed and thus, relative to the shutter forming system is sacrificial. The insert 46 can be preferably box-shaped or rectangularly-shaped to provide the sides of the shutter assembly 10 with a desired depth. The top two sections 34, 36 of the tool 30A can be rotated about the living hinge 56 between the first and the second sections 32, 34 into a horizontal position. The third section 36 of the tool 30A can then be rotated about the living hinge 58 between the second and third sections 34, 36, which is shown in FIG. 6. Thus, the sections 32, 34 and 36 surround four-sided insert 46 on three sides, with mold face 28 superposing the insert's fourth side. The slurry-laden reinforcement mat 42 is thus folded about insert 46, which serves as a mandrel component of the shutter forming system. After the slurry has dried, the tool 30A has formed a rigid edge 48 that is substantially box-shaped to provide strength and rigidity to the shutter assembly 10 and an adequate depth to the shutter assembly 10. A cross-sectional view of the shutter assembly 10 having two opposed rigid edges 48 formed therefrom is shown in FIG. 7. These two rigid edges 48 may form opposed vertical sides 26 of shutter 20.

The inserts 46 about which rigid edges 48 are defined can remain in the shutter assembly 10 after the slurry has dried and, having been sacrificed from the shutter forming system, comprise a portion of the rigid edge. The insert 46 is preferably formed of lightweight material that adds negligible weight to the shutter assembly 10. One preferred type of material forming the insert 46 is a foam material. Other suitable materials that can be used to form the insert 46 include aluminum, plastic, and/or the like. As noted above, the sacrificed mandrel/insert captured within the surrounding cementitious slurry/mat combination may remain a part of shutter 20, as shown in the Figures.

Figure 8:
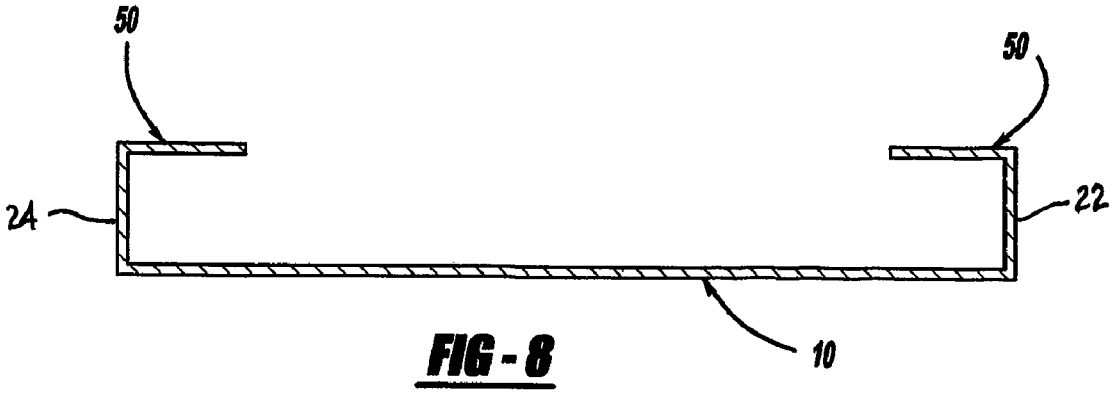
FIG. 8 is a longitudinal cross-sectional view of the shutter assembly having two hanger edges.

Referring to FIG. 8, hanger edges 50 can be used for mounting the shutter assembly to the dwelling 12 instead of driving fasteners through the shutter assembly 10. The hanger edges 50 can be formed from another embodiment of the tool system 30, a pair of second type tools 30B each having only the first and the second sections 38, 40, respectively, for forming an L-shaped configuration. Each tool 30B may be located at opposing edges of the mold face 28, perhaps in conjunction with a pair of tools 30A on opposing adjacent edges extending between tools 30B. A longitudinal cross-sectional view of the shutter assembly 10 having two L-shaped hanger edges 50 formed therefrom is shown in FIG. 8, although other configurations can be used in accordance with present invention. By way of a non-limiting example, with reference to FIGS. 4 and 5, in forming hanger edges 50 the insert 46 can be positioned in the corner formed between mold surface 28 and first section 38 of tool 30B in a manner similar to that described above regarding use of tool 30A, and the second section 40 of tool 30B is rotated about the living hinge 60 while the slurry is still wet. After the slurry has dried, the tool 30B and the insert 46, which serves as a mandrel, are removed to form the L-shaped hanger edge 50. Various mounting brackets can be mounted to the dwelling 12 for engaging the L-shaped hanger edges 50.

Figure 9:
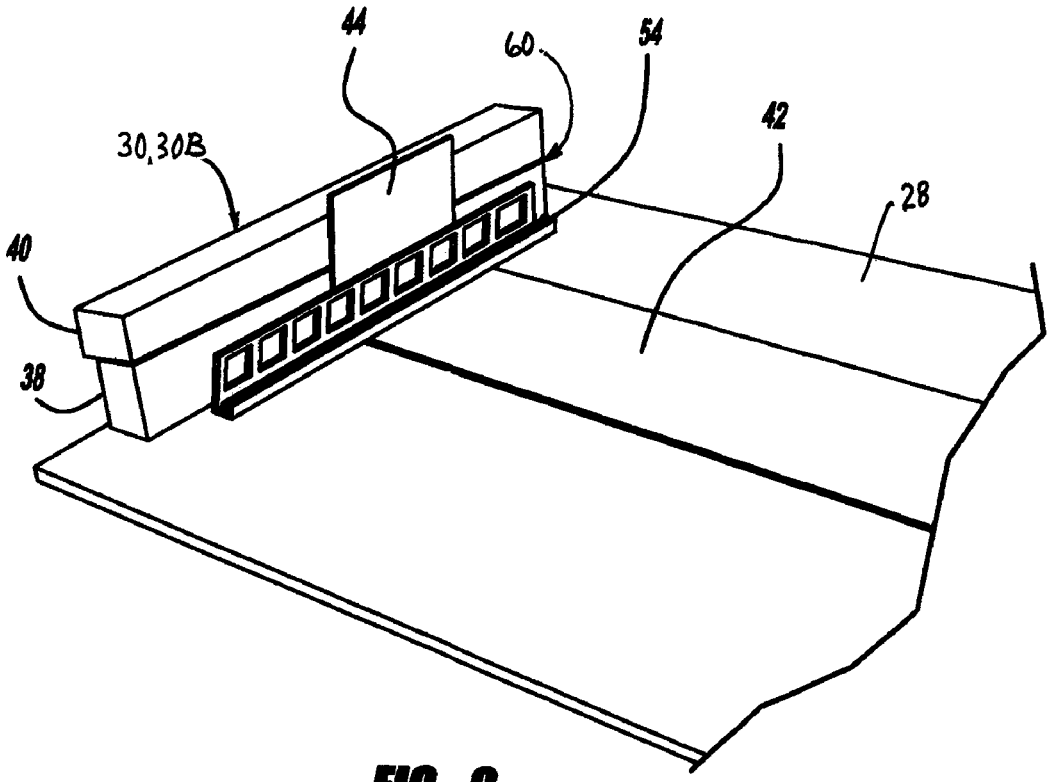
FIG. 9 is a partial perspective view of the mold portion and the second type tool having an alternate insert for use in forming a rigid edge of the shutter assembly.
Figure 10:
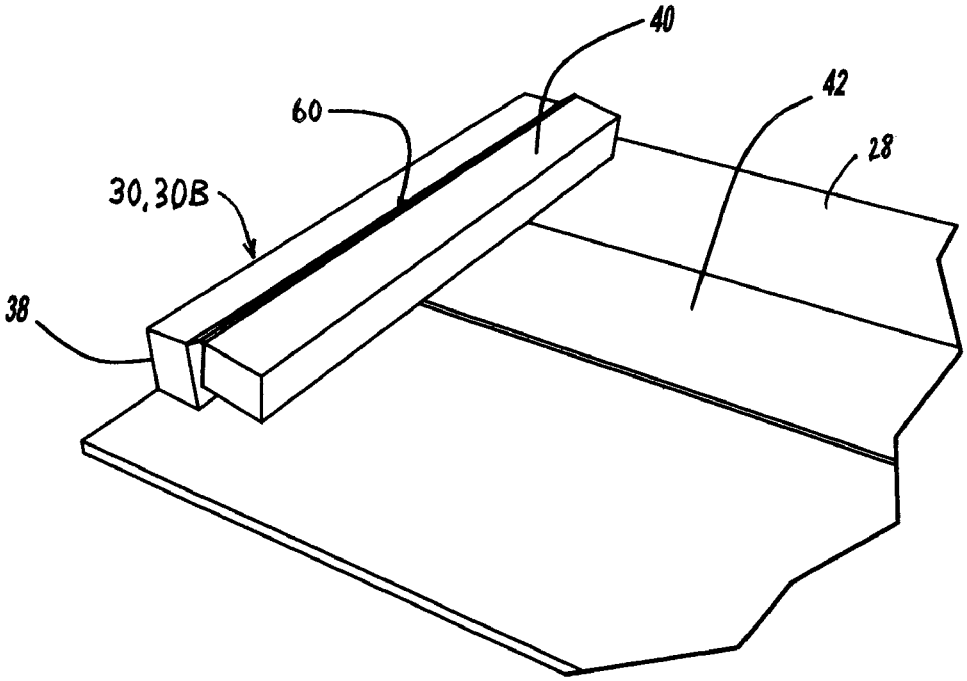
FIG. 10 a perspective view of the mold portion and the second type tool of FIG. 9 after forming the rigid edge.
Figure 11:
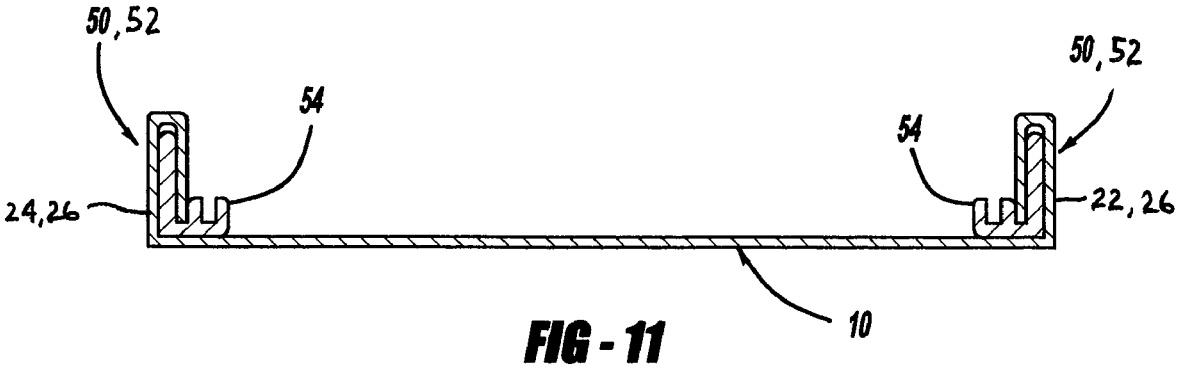
FIG. 11 is a cross-sectional view of the shutter assembly having two rigid edges formed according to FIGS. 9 and 10.

Alternatively, another embodiment of the rigid edges 52 is shown in FIGS. 9-11. The tool 30B can be used to form the rigid edge 52. Referring to FIG. 9, the reinforcing mat 42 has been positioned in the mold on mold face 28 and the cementitious slurry has been sprayed into the mold and over mat 42. A plastic insert 54 can be positioned in the corner formed between mold face 28 and lower section 38 of tool 30B. While the slurry is wet, the upper section 40 of tool 30B can be rotated sufficiently, e.g., 180°, to secure the insert 54 as shown in FIG. 10. Once the slurry dries, the tool 30B can be removed, with the rigid edge 52 having been formed. A cross-sectional view of the shutter assembly 10 having two rigid edges 52 formed therefrom is shown in FIG. 11. Insert 54, which like insert 46 serves as a mandrel, may be sacrificed from the shutter forming system and remain with the formed shutter as part of edge 52. As indicated below, edge 52 may also represent a hanger edge.

In any of the embodiments described above, a vacuum source can be applied to the mold to force any gases from the cementitious slurry and the mold and to ensure that the slurry has been adequately dispersed through the fibers of mat 42 and into all surface features defined in mold face 28. The vacuum source can also be used to form the hanger edges 50, 52 and the rigid edges 48, 52 with or without the use of the tool 30.

For example, the cementitious slurry and the either the reinforcing mat 42 or the fibers can be disposed in the mold. The mold includes vertical sides in place of the sides of the tool 30. Next, the insert 46, 54 can be positioned adjacent the desired edges. A flexible membrane can be positioned about the mold and the vacuum source can be activated to draw the membrane about the mold. The drawing of the membrane to the mold forms the edges about the insert 46, 54 to form the rigid edge 48, 52 and the hanger edge 50, 52. As another example, the tool can also be used. The tool can be rotated to form the desired edges and then the membrane can be positioned over the mold and the vacuum can be applied. Alternatively, the flexible membrane can be positioned over the mold prior to rotating the tool such that the flexible membrane will pull the tool down once the vacuum is applied.

While the invention has been described with reference to an exemplary embodiment, it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for forming a shutter assembly, comprising:

a mold system having a mold face formed thereon;

a tool system proximate to an edge portion of the mold face; and a mandrel separable from the mold system and the tool system;

wherein the tool system includes at least two portions, wherein a first portion is rotatable about a living hinge disposed between the first portion and a second portion, wherein the second portion and mold face meet to define a corner in which the mandrel is disposed;

wherein the first rotatable portion is selectively operable to manipulate an insert member disposed on the mold face and under the mandrel so as to form on the insert member a configuration selected from the group consisting of a hanger edge, a rigid edge, and combinations thereof;

the tool system having a folded state in which the mandrel is at least partially surrounded by the tool system and the mold face.

2. The system for forming a shutter assembly according to claim 1, the tool system further comprising a third portion, wherein the third portion is rotatable about a living hinge disposed between the first portion and the third portion.

3. The system for forming a shutter assembly according to claim 2, wherein the third rotatable portion is selectively operable to manipulate an insert member disposed on the mold face so as to form on the insert member a configuration selected from the group consisting of a hanger edge, a rigid edge, and combinations thereof.

4. The system for forming a shutter assembly according to claim 2, wherein the mandrel is substantially enveloped by the mold face and the first, second and third portions in the tool system folded state.

5. The system for forming a shutter assembly according to claim 1, wherein the insert member comprises a reinforcement material.

6. The system for forming a shutter assembly according to claim 1, wherein the mandrel comprises a second insert member that remains with the formed shutter assembly.

7. The system for forming a shutter assembly according to claim 6, wherein the tool system is selectively operable to be manipulated to substantially surround surfaces of the mandrel that do not superpose the mold face, and substantially envelope the second insert member.

8. The system for forming a shutter assembly according to claim 6, wherein the second insert member comprises a material selected from the group consisting of a foam material, plastic material, and combinations thereof.

9. The system for forming a shutter assembly according to claim 1, wherein the mandrel includes a substantially square or rectangular cross-section, one side of which superposes the mold face, at least two sides of which are surrounded by the tool system in its folded state.

10. The system for forming a shutter assembly according to claim 1, wherein the shutter assembly is comprised of a cementitious material.

11. The system for forming a shutter assembly according to claim 1, wherein the mandrel is sacrificial.

12. The system for forming a shutter assembly according to claim 1, wherein the mandrel is substantially enveloped by the mold face and the first and second portions in the tool system folded state.

13. A system for forming a shutter assembly, comprising:

a mold system having a mold face formed thereon;

a tool system proximate to an edge portion of the mold face; and a mandrel separable from the mold system and the tool system;

wherein the tool system includes at least three portions, wherein a first portion is rotatable about a first living hinge disposed between the first portion and a second portion, wherein the second portion is rotatable about a second living hinge disposed between the second portion and a third portion, the third portion and the mold face defining a corner in which the mandrel is disposed;

wherein the first and second rotatable portions are selectively operable to manipulate an insert member disposed on the mold face and under the mandrel so as to form on the insert member a configuration selected from the group consisting of a hanger edge, a rigid edge, and combinations thereof;

the tool system having a folded state in which the mandrel is at least partially surrounded by the tool system and the mold face.

14. The system for forming a shutter assembly according to claim 13, wherein the insert member comprises a reinforcement material.

15. The system for forming a shutter assembly according to claim 13, wherein the mandrel comprises a second insert member that remains with the formed shutter assembly.

16. The system for forming a shutter assembly according to claim 15, wherein the tool system is selectively operable to be manipulated to substantially surround surfaces of the mandrel that do not superpose the mold face, and substantially envelope the second insert member.

17. The system for forming a shutter assembly according to claim 15, wherein the second insert member comprises a material selected from the group consisting of a foam material, plastic material, and combinations thereof.

18. The system for forming a shutter assembly according to claim 13, wherein the mandrel includes a substantially square or rectangular cross-section, one side of which superposes the mold face, at least two sides of which are surrounded by the tool system in its folded state.

19. The system for forming a shutter assembly according to claim 13, wherein the shutter assembly is comprised of a cementitious material.

20. The system for forming a shutter assembly according to claim 13, wherein relative to the shutter forming system the mandrel is sacrificial.

21. The system for forming a shutter assembly according to claim 13, wherein the mandrel is substantially enveloped by the mold face and the tool system in the tool system folded state.

* * * * *